United States Patent [19]

McCambridge

[11] Patent Number: 5,075,971

[45] Date of Patent: Dec. 31, 1991

[54] METHODS AND APPARATUS FOR TRIMMING HAIR AND DISPOSING OF HAIR CLIPPINGS

[75] Inventor: James E. McCambridge, Polo, Ill.

[73] Assignee: Wahl Clipper Corporation, Sterling, Ill.

[21] Appl. No.: 553,933

[22] Filed: Jul. 17, 1990

[51] Int. Cl.[5] ..... B26B 19/20; B26B 19/44

[52] U.S. Cl. ..... 30/133; 30/43.6

[58] Field of Search ..... 30/133, 41, 42, 43.9, 30/43.91, 43.6, 43.8, 133

[56] References Cited

U.S. PATENT DOCUMENTS

| | | | |
|---|---|---|---|
| 2,323,046 | 6/1943 | Jenkins | 30/133 |
| 3,604,112 | 9/1971 | Bhavnani | 30/133 |
| 4,188,720 | 2/1980 | Kore | 30/133 |
| 4,216,581 | 8/1980 | Van Slooten | 30/133 |
| 4,843,717 | 7/1989 | Crane | 30/133 |
| 4,899,442 | 2/1990 | Horii et al. | 30/43 |
| 4,972,584 | 11/1990 | Baumann | 30/133 |

OTHER PUBLICATIONS

Wahl EZ Trimmer.
Panasonic Personal Grooming Device, No. ER112BC.
Wonder Trimmer.
Remington Hygienic Clipper, No. NE-1.
Naso-Clipper, No. JR-101.
Proshave Hair Trimmer, No. HT-555.
Nepenthe Nasal Hair Trimmer, No. SC737.
Rhino-Clipper, No. UN 802.
Minicut, Mitsui Electric.
Accutrim.
Hahrex-M8.

*Primary Examiner*—Douglas D. Watts
*Assistant Examiner*—Paul M. Heyrana, Sr.
*Attorney, Agent, or Firm*—Welsh & Katz, Ltd.

[57] ABSTRACT

A cordless hair trimmer has a reciprocating blade system adapted for delicate trimming in small, sensitive body areas such as the eyebrows, ears and nose. An air inlet is provided adjacent to the blades, and a vacuum is created at the air inlet by a suction fan inside the trimmer. The fan draws air through the inlet to a chamber at the bottom of the device, where hair clippings are collected until a clean-out door is removed and the chamber is emptied. The fan also creates air pressure at the blades which inhibits the accumulation of cut hair strands in the blades and blade mechanism.

13 Claims, 4 Drawing Sheets

METHODS AND APPARATUS FOR TRIMMING HAIR AND DISPOSING OF HAIR CLIPPINGS

This invention relates to methods and apparatus for trimming hair, and more particularly, to methods and apparatus for trimming hair from the ears, eyebrows, nose and other parts of the body, and disposing of the resulting hair clippings.

BACKGROUND OF THE INVENTION

Hair trimmers are available which trim eyebrow, ear and nose hair in a safe and efficient manner. Some trimmers have a hollow, cylindrical fixed blade with a plurality of teeth in the top of the blade. An internal blade rotates inside the cylinder, cutting hair as it passes the cutting edges of the teeth in the fixed blade. With this blade configuration, there is an opening inside the blades which extends into the interior of the device. Hair strands which are placed between two teeth on the stationary blade are properly cut by the revolving blade, but hair strands which are in the opening in the fixed blade are not cut by the revolving blade, and the device must be manipulated to cut those hair strands.

In one rotating blade trimmer, a propeller fan is provided to draw air through the opening in the fixed blade, trapping some of the cut hair strands inside the device. The top of the device, including the fixed blade, can be removed for periodic disposal of the trapped clippings. However, the air flow pattern through the device, and the configuration of the blade fan, create limited vacuum near the blades. In addition, known rotary blade trimmers are long in relation to the size of the blades, and the weight is distributed away from the blades. These design characteristics make the rotary blade trimmers more difficult to manipulate, particularly in small areas such as the inside of the ears and nose.

Eyebrow, ear and nose trimmers are also available with reciprocating blades. Such trimmers can be easy to manipulate, but a separate air inlet with a vacuum source must by provided to remove cut hair strands. Moreover, hair strands can accumulate in the blades and interior blade mechanism.

Accordingly, one object of this invention is to provide new and improved methods and apparatus for trimming hair.

Another object is to provide new and improved methods and apparatus for trimming hair from the ears, eyebrows, nose and other parts of the body, and removing the resulting hair clippings.

Still another object is to provide new and improved cordless eyebrow, ear and nose trimmers which use reciprocating blades, and collect hair trimmings for disposal.

Yet another object is to provide new and improved cordless eyebrow, ear and nose trimmers with improved internal air flow for trapping hair clippings for disposal.

A still further object is to provide new and improved eyebrow, ear and nose trimmers which do not accumulate hair clippings in the blades and blade mechanism.

SUMMARY OF THE INVENTION

In keeping with one aspect of this invention, a cordless hair trimmer has reciprocating blades adapted for delicate trimming in small, sensitive body areas such as the eyebrows, ears and nose. A two piece shell has a plurality of partitions which secure, among other things, the blades, a blade mechanism, a motor, a battery, and a suction fan in the shell.

An air inlet is provided in the shell adjacent to the blades, and a vacuum is created at the air inlet by the suction fan. The fan draws air through the inlet to a chamber at the bottom of the device, where hair clippings are collected until a clean-out door is removed and the chamber is emptied.

In addition to creating a vacuum at the air inlet, the suction fan forces air over the motor to cool it during operation, and creates air pressure at the blades which inhibits accumulation of hair strands in the blades and blade mechanism. The suction fan has a two piece construction which simplifies the manufacturing process and improves balance.

The battery is located adjacent the motor, near the blades, for improved weight distribution. A battery cap is provided for easily changing the battery. The battery cap is next to the clean-out door, and interlocks with the clean-out door, to secure the covers together, and better secure the two halves of the shell. The battery cap and clean-out door are secured to the shell differently, however, so they cannot be inadvertently installed incorrectly.

BRIEF DESCRIPTION OF THE DRAWINGS

The above mentioned and other features of an embodiment of this invention and the manner of obtaining them will become more apparent, and will be best understood by reference to the following description, taken in conjunction with the accompanying drawings, in which.

DETAILED DESCRIPTION

Figure 1:
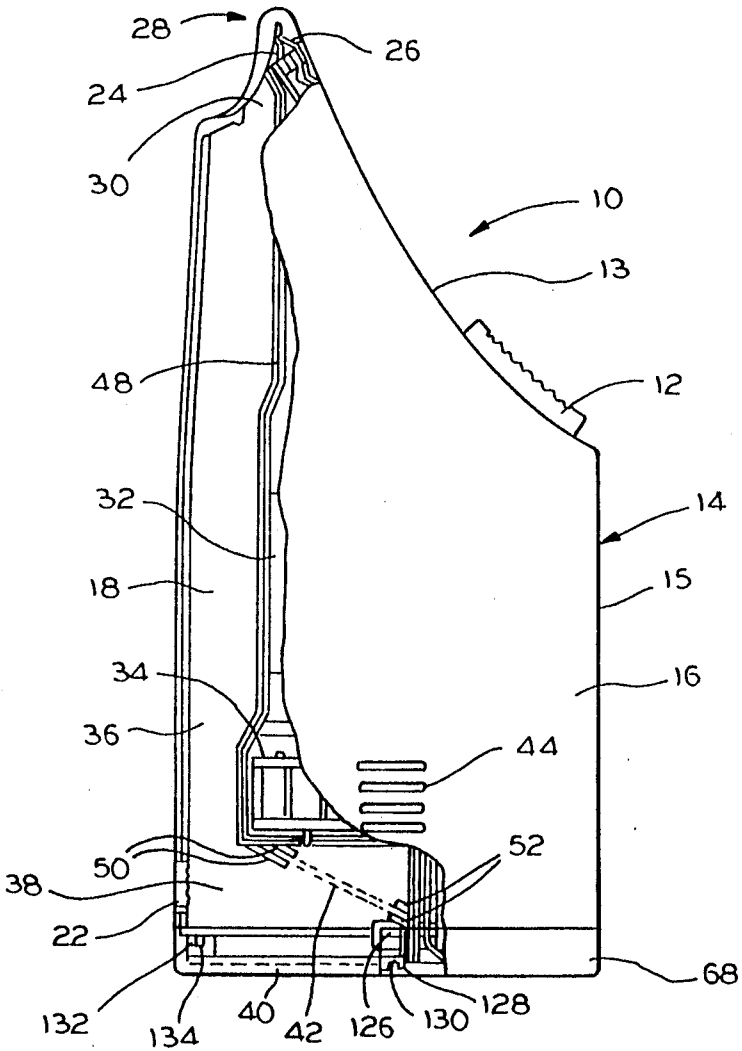
FIG. 1 is a partially cutaway view of apparatus made in accordance with the principles of this invention.

As seen in FIG. 1, apparatus 10 is a compact, hand held hair trimmer which is adapted for trimming hair from the eyebrows, ears, nose, and other delicate parts of the body. The apparatus 10 is preferably battery operated, and is easily controlled by an on-off switch 12.

The apparatus 10 includes a shell 14 having two halves 16, 18 (FIGS. 1 and 2) which are essentially mirror images of each other. The halves 16, 18 mate at a parting line 20, and are secured together by any suitable structure, such as interlocking hooks and indentations 22. An open-ended boss 21 in the shell half 18 mates with a press fit pin (not shown) in the shell half 16 to further secure the shell halves together.

Figure 13:
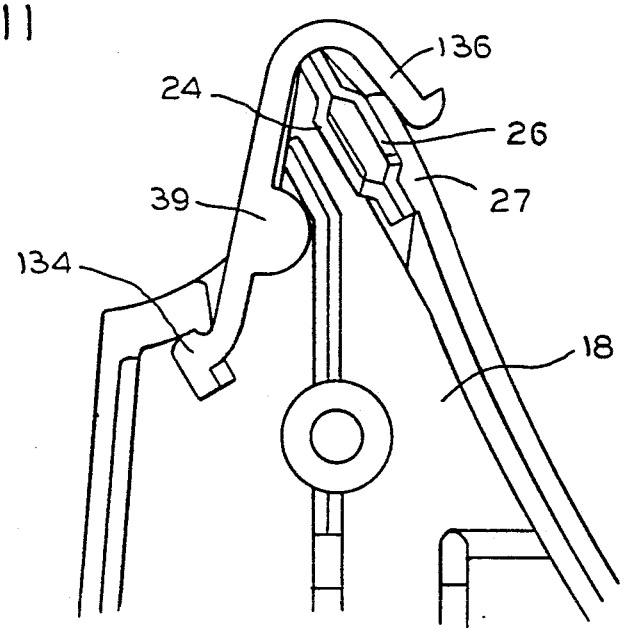
FIG. 13 is an enlarged side view of a portion of the apparatus of FIG. 1, showing a blade guard installed on the apparatus.

A reciprocating blade 24 and a stationary blade 26 protrude at an end 28 of the apparatus 10 (FIGS. 1 and 13). The reciprocating blade 24 may be recessed from the stationary blade 26. The stationary blade 26 is fixed in place in part by an indentation 27 in the shell halves 16, 18.

The on-off switch 12 is located on a wall side 13 os the shell 14, and extends from about the center of the shell 14 towards the blades 24, 26, at an angle of about 45 degrees to an adjacent wall 15. The switch 12 is located at about the middle of the shell 14. In this manner, the user can comfortably hold the apparatus 10 and control the blades 24, 26.

Figure 3:
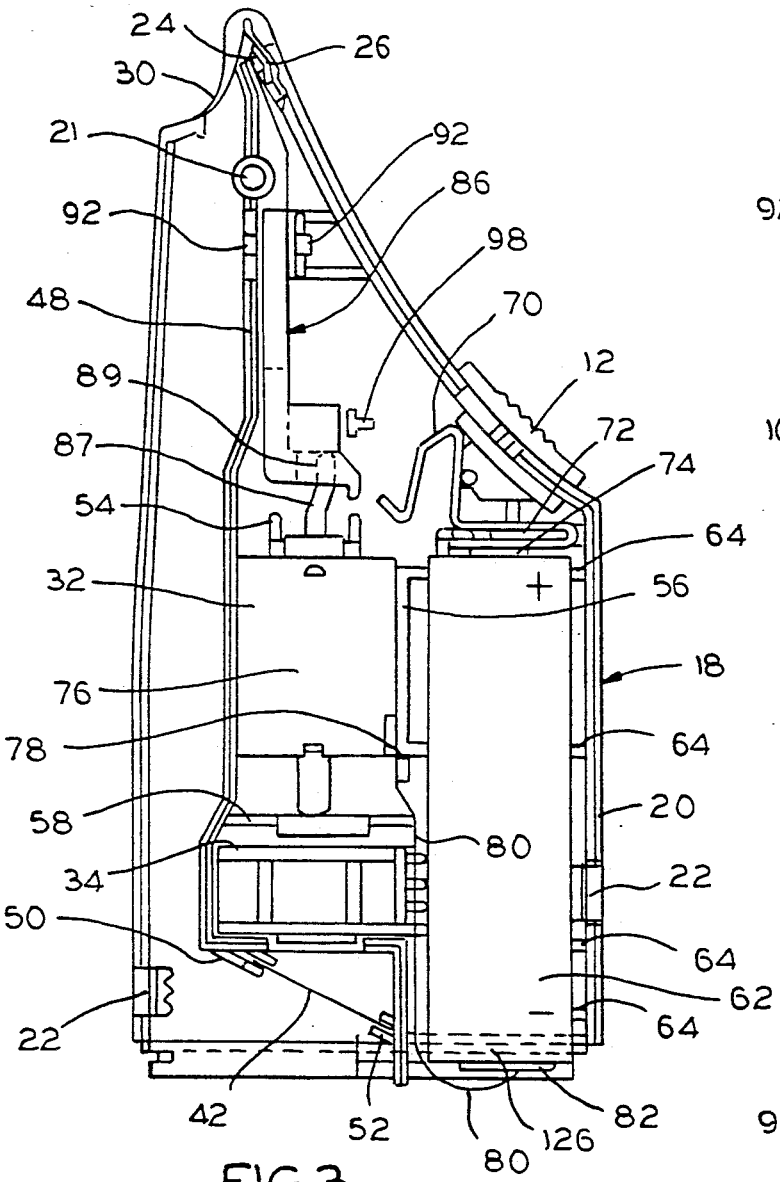
FIG. 3 is an elevational view of the inside of one half of the shell used in the apparatus of FIG. 1, with the internal parts, the clean-out door and the battery cap in place.
Figure 16:
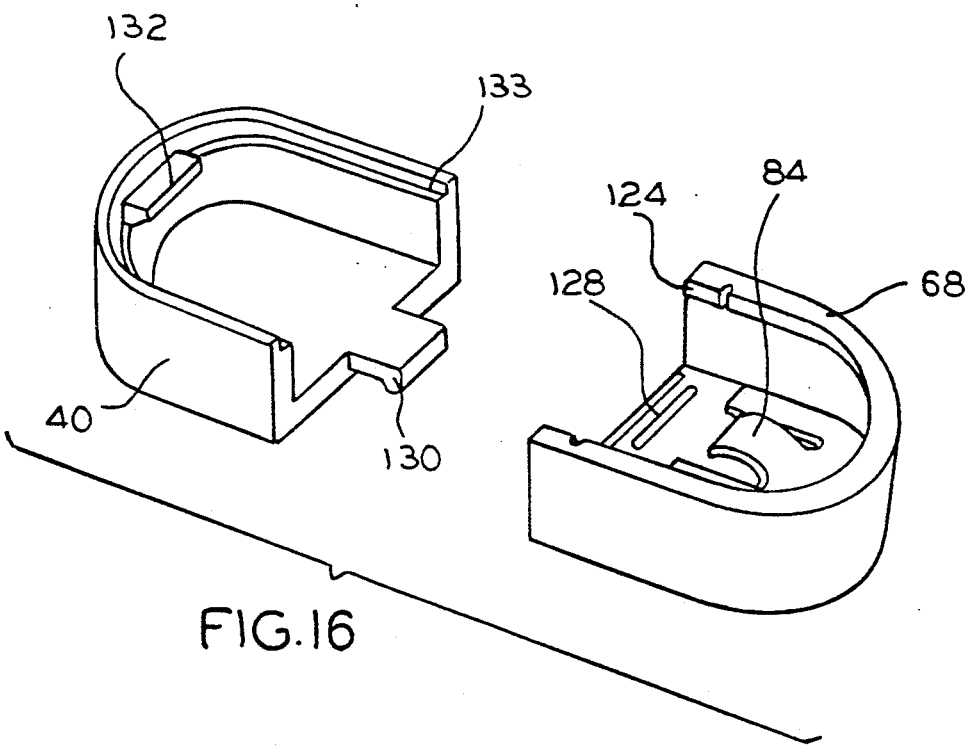
FIG. 16 is a perspective view of the clean-out door and battery cap used in the apparatus of FIG. 1.

An air intake port 30 is provided adjacent to the blades 24, 26. Hair which is cut by the blades 24, 26 is drawn into the intake port 30 by a vacuum created by a motor 32 and a fan 34. The hair clippings travel through an air shaft 36 to a collection area 38, and can be removed for disposal by removing a clean-out door 40 (FIGS. 3 and 16). A blade guard 39, shown in FIG. 13, covers the air intake port 30 when the apparatus 10 is not in use, to prevent hair clippings from escaping from the apparatus 10. The blade guard 39 also covers and protects the blades 24, 26.

A filter 42, which can be a screen or the like, is located between the fan 34 and the collection area 38 (FIG. 1) to keep hair clippings in the collection area 38. The filter 42 is located in the top and side surfaces of the collection area 38, away from the air shaft 36. This configuration better draws hair clippings out of the air shaft 18, into the area 38.

Figure 2:
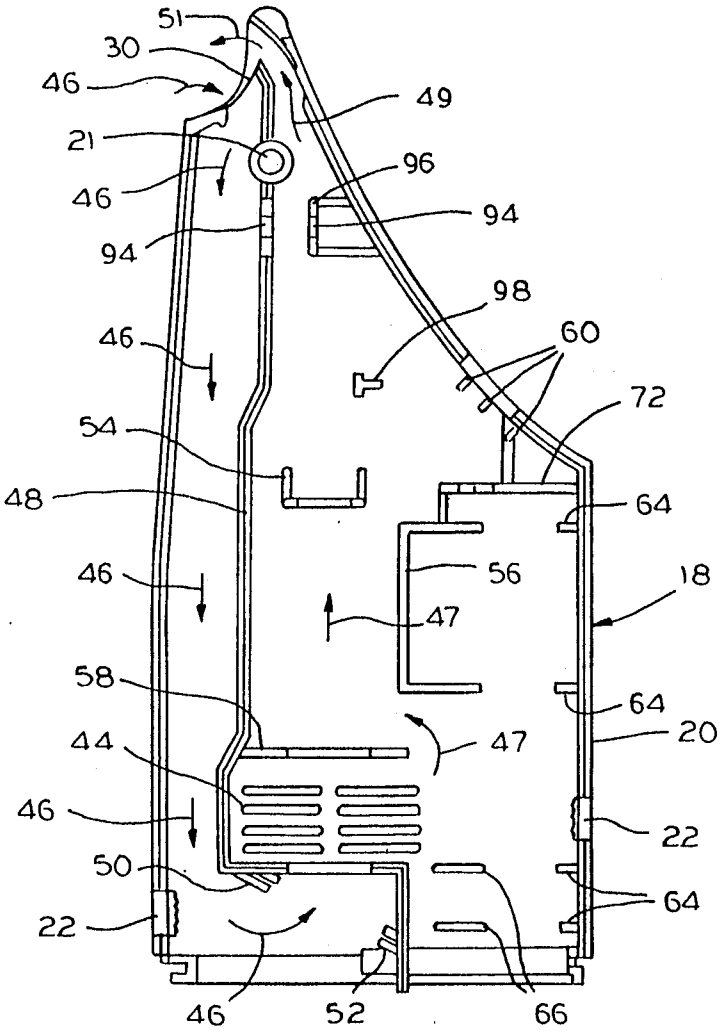
FIG. 2 is an elevational view of the inside of one half of the shell used in the apparatus of FIG. 1, with the internal parts removed.

Air which is drawn through the shaft 36 and collection area 38 also passes through the filter 42. Some of that air exits through vents 44 provided in the halves 16, 18. The direction of that airflow is shown in FIG. 2 by arrows 46. Some of the air passes over the motor, in the direction of arrows 47, and that air passes across the blades 24, 26, as shown by arrow 49, creating air pressure which inhibits undesired accumulation of cut hair strands in the blades 24, 26 and shell 14. Also, some of the air which passes over the blades 24, 26 is drawn back into the air inlet 30, in the manner shown by arrow 51, which further encourages the accumulation of hair strands in the collection chamber 38.

The halves 16, 18 can be made of plastic, and can be easily molded to include a plurality of interior partitions (FIG. 2) which define the air shaft 36 and the collection area 38. The partitions also secure the motor 32 and other parts of the apparatus 10 in the shell 12. A partition 48 defines a portion of the air shaft 36, and partitions 50, 52 secure the filter 42 in place. The motor 32 is secured in place by partitions 54, 56 and 58 (FIGS. 2 and 3), and the switch 12 is secured and guided by partitions 60, as well as the parting line 20.

A battery 62 is located next to the motor 32 by partitions 56, 64 and 66, and a removable battery cap 68 provides access to the battery 62. The location of the battery 62 adjacent the motor 32 distributes the weight in the apparatus 10 so that most of the weight of the device is in the palm of the user's hand during use, with the user's thumb on the switch 12. This feature improves the user's control over the device, particularly when trimming hair in small areas.

A spring conductor 70 is secured to a partition 72, and makes an electrical connection to a positive terminal 74 of the battery 62. When the switch 12 is pushed upwards in FIG. 3, the spring conductor 70 is pressed into contact with a metal case 76 of the motor 32. An electrical terminal 78 is electrically connected to the metal case 76.

Figure 14:
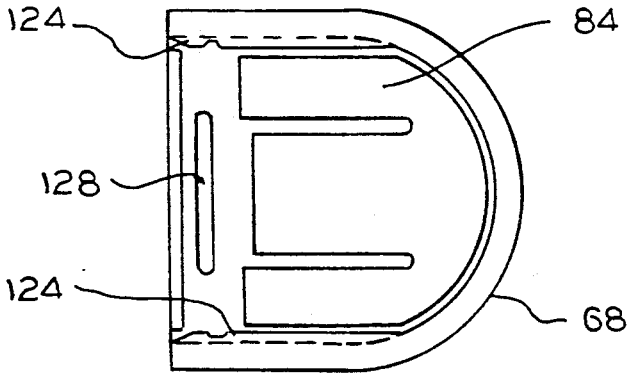
FIG. 14 is an inside view of the battery cap for the apparatus of FIG. 1.

A second conductor 80 is electrically connected to a second electrical terminal (not shown in FIG. 3) of the motor 32. The second conductor 80 is connected to a negative terminal 82 of the battery 62 through a conductor 84 (FIG. 14) on the battery cap 68.

Figure 4:
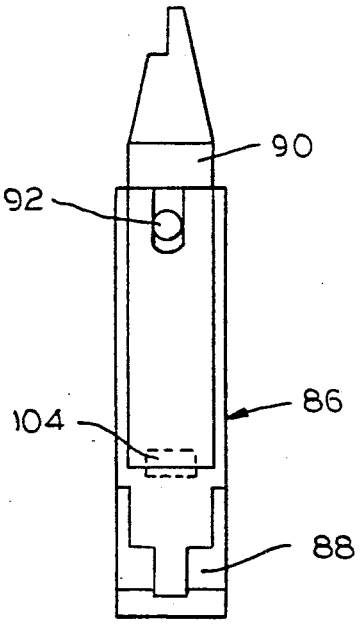
FIG. 4 is a side view of the drive assembly of the apparatus of FIG. 1.
Figure 5:
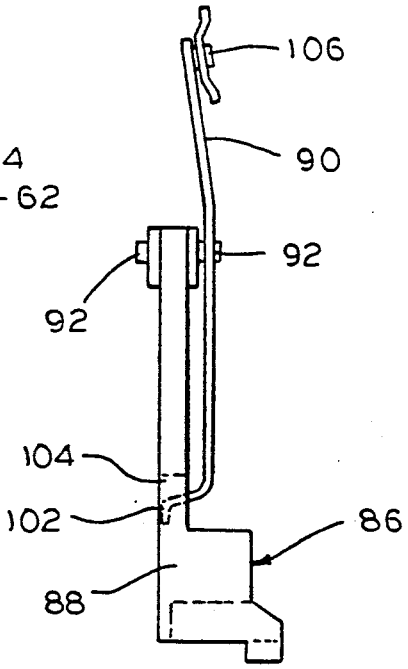
FIG. 5 is a front view of the drive assembly of FIG. 4.
Figure 6:
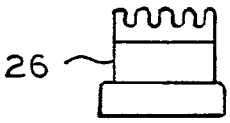
FIG. 6 is an inside view of the stationary blade of the apparatus of FIG. 1.

The motor 32 simultaneously operates both the fan 34 and the reciprocating blade 24, although two motors could be used for these purposes. The reciprocating blade is moved by a drive assembly 86, shown in FIGS. 4 and 5. The motor 32 has a rotating shaft 87 which has an offset end 89 (FIG. 3). The offset end 89 eliminates the need for a separate cam device, which reduces manufacturing costs.

The drive assembly 86 includes a pivoting bar 88 and a spring arm 90. The pivoting bar 88 includes a pair of arms 92 which are secured in two indentations 94, one of which is in the partition 48, the other of which is in a partition 96. The bar 88 is also secured against undesired lateral movement by a partition 98. The offset end 89 of the motor shaft 87 is inserted through an elongated orifice 100 in the bar 88 to reciprocate the bar 88 as the shaft 87 rotates.

The spring arm 90 is secured to the bar 88 by inserting an end 102 into an orifice 104 in the bar 88. A flag 106 is provided which fits in an opening 107 in the reciprocating blade 24. In this manner, rotation of the motor shaft 87 pivots the assembly 86, causing the blade 24 to reciprocate in the desired manner.

Figure 8:
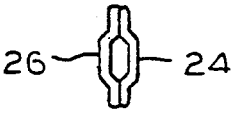
FIG. 8 is a side view of the blades of FIGS. 6 and 7.
Figure 7:
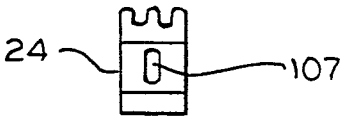
FIG. 7 is an inside view of the reciprocating blade of the apparatus of FIG. 1.

The flag 106 is elongated vertically so that the flat surfaces of the reciprocating blade are properly aligned with the corresponding surfaces of the stationary blade 26, as in FIG. 8, but do not move vertically.

Figure 11:
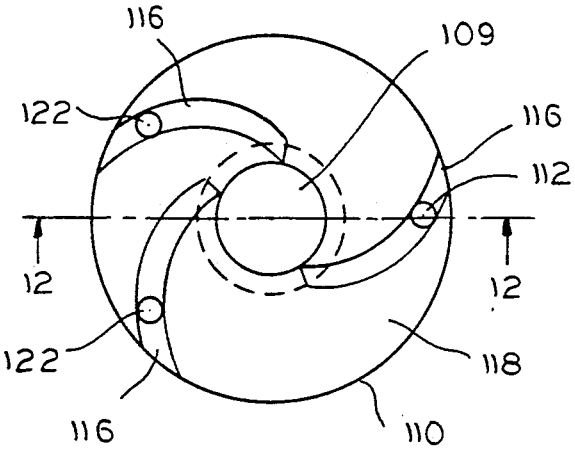
FIG. 11 is a front view of the bottom piece of the fan in the apparatus of FIG. 1.

The fan 34 is a suction fan which draws air into a center opening 109 (FIG. 11). The fan 34 performs three functions. First, it creates the vacuum needed at the air inlet 30. Second, the fan 34 forces air over the motor 32 to cool the motor 32 during operation. Third, the fan 34 creates he positive air pressure at the blades 24, 26, which inhibits hair clippings from accumulating in the blades and the blade mechanism 86. While a single fan is preferably used to perform these three functions, it is contemplated that two or more fans could also be used for these purposes, if desired.

Figure 9:
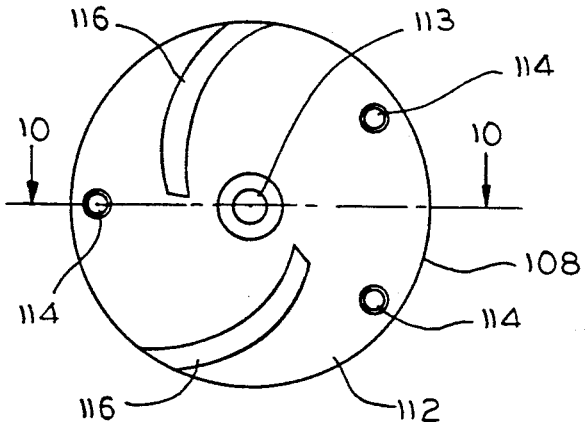
FIG. 9 is a front view of the top piece of the fan in the apparatus of FIG. 1.
Figure 10:
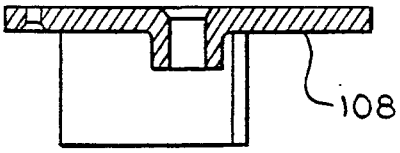
FIG. 10 is a sectional view of the top piece of the fan shown in FIG. 9, taken along lines 10—10 in FIG. 9.
Figure 12:
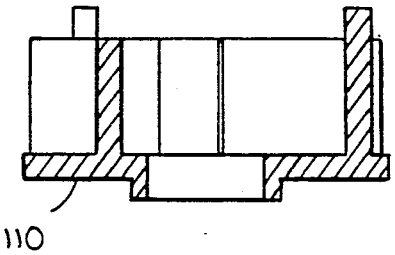
FIG. 12 is a sectional view of the bottom piece of the fan shown in FIG. 11, taken along lines 12—12 in FIG. 11.

The fan 34 is of two piece construction, and includes a top 108 (FIGS. 9 and 10) and a bottom 110 (FIGS. 11 and 12). The top 108 includes a flat, round surface 112, a center opening 113 for the motor shaft 87, three orifices 114, and two ribs 116. The ribs 116 curve in a trailing manner as the fan rotates, to move air away from the center opening 113.

The bottom 110 (FIGS. 11 and 12) includes a flat face 118, the center opening 109 for drawing air into the fan 34, three pegs 122 which fit into the orifices 114 for assembly, and three additional ribs 116. The ribs 116 are spaced so that they are substantially equidistant from each other when the fan 34 is assembled.

Figure 15:
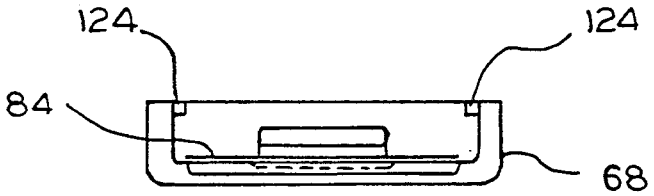
FIG. 15 is a side view of the battery cap of FIG. 14.

The clean-out door 40 and the battery cap 68 are removably secured to the shell 14 by any suitable structure. The battery cap 68 (FIGS. 14, 15 and 16) includes ridges 124 which fit into grooves 126 (FIG. 3) in the shell 14, and an indentation 128 which interlocks with a protrusion 130 in the clean-out door 40. The clean-out door 40 (FIG. 16) is secured in place by the protrusion 130, and a protrusion 132 which fits in an opening 134 in the shell 14. An interlock 133 seals the chamber 38.

The clean-out door 40 and the battery cap 68 are secured to the shell halves in different manners to prevent them from being installed in the wrong place. The clean-out door 40 and the battery cap 68 perform the additional function of securing the shell halves 16, 18 together better. However, the battery cap 68 preferably has the ridge and groove construction shown in the drawings, to compensate for the pressure created by the conductor 84, which holds the battery 62 firmly in place.

The blade guard 39 (FIG. 13) is adapted to fit over the air inlet 30 and the blades 24, 26. The blade guard 39 includes a lower lip 134 which rests inside the inlet 30, and an upper lip 136, which is removably secured over the blades 24, 26. The blade guard 39 is preferably flexible enough to be easily removed by the user's fingers.

The many advantages of this invention are now apparent. Ear, eyebrow and nose hair is easily and efficiently removed using reciprocating blades, and cut hair strands are collected in the trimmer for periodic disposal, using improved air flow for hair removal. The two-piece suction fan which creates the vacuum needed to collect the hair clippings. In addition, it is easy to manufacture and is well balanced. Also, the motor drives both the hair cutting blades and the fan, and the fan cools the motor, as well as create a vacuum. The fan also creates positive air pressure at the blades, to inhibit hair strand accumulation in the blades and drive mechanism. These multiple functions result in a less expensive product, and more efficient production.

While the principles of the invention have been described above in connection with specific apparatus and applications, it is to be understood that this description is made only by way of example and not as a limitation on the scope of the invention.

I claim:

1. Apparatus for trimming hair and recovering cut hair strands for disposal comprising a shell, a stationary blade and a reciprocating blade secured in a selected end of said shell, means in said shell for moving said reciprocating blade to trim the hair, an air inlet adjacent said stationary blade and said reciprocating blade, means for creating a vacuum in said air inlet adjacent to said blades, means for storing cut hair strands which are drawn into said air inlet by said vacuum, means for removing cut hair strands from said storing means, and means in said shell for creating air pressure at said blades, said air pressure creating means moving air over said blades in a direction which is out of and away from said shell, the moving air being in communication with the vacuum created by said vacuum creating means, whereby undesired accumulation of cut hair strands in said shell is inhibited, and cut hair strands are removed and stored for disposal.

2. The apparatus of claim 1 comprising means for cooling said means for moving said reciprocating blade.

3. The apparatus of claim 2 wherein said pressure creating means, said vacuum creating means and said cooling means comprises a single fan.

4. The apparatus of claim 3 wherein said fan comprises a rotating suction fan having two spaced, flat surfaces separated by a plurality of curved ribs, and a center opening in one of said flat surfaces for drawing air between said flat surfaces.

5. The apparatus of claim 4 wherein said fan comprises a top piece, a bottom piece, and means for securing said top piece to said bottom piece, said top piece and said bottom piece each having at least one of said ribs.

6. The apparatus of claim 4 wherein said reciprocating blade moving means comprises a motor, said motor also turning said fan.

7. The apparatus of claim 1 comprising filter means for isolating the hair strands from said vacuum creating means.

8. The apparatus of claim 7 wherein said filter means comprises a screen.

9. A method for trimming hair and recovering cut hair strands for disposal comprising the steps of securing a stationary blade and a reciprocating blade in a selected end of a shell, moving said reciprocating blade to trim the hair, creating a vacuum in an air inlet adjacent said stationary blade and said reciprocating blade, creating air pressure at said blades, the air pressure moving air over said blades in a direction which is out of and away from said shell, the moving air being in communication with the vacuum created in said air inlet, storing cut hair strands which are drawn into said air inlet by said vacuum, and removing said stored hair strands from said storing means, whereby undesired accumulation of cut hair strands in said shell is inhibited, and cut hair strands are removed and stored for disposal.

10. Apparatus for trimming hair and recovering cut hair strands for disposal comprising a shell, means for storing a battery in said shell, said battery storage means having a battery end cap in said shell for installing and removing the battery, a stationary blade and a reciprocating blade secured in a selected end of said shell, means in said shell for moving said reciprocating blade to trim the hair, an air inlet adjacent said stationary blade and said reciprocating blade, means for creating a vacuum in said air inlet, means for storing cut hair strands which are drawn into said air inlet by said vacuum, means for removing cut hair strands from said storing means, said removing means including a clean-out door for removing the cut hair strands from said storing means, and means for creating air pressure at said blades, said air pressure creating means moving air over said blades in a direction which is out of and away from said shell, the moving air being in communication with the vacuum created by said vacuum creating means, whereby undesired accumulation of cut hair strands in said shell is inhibited, and cut hair strands are removed and stored for disposal.

11. The apparatus of claim 10 wherein said shell comprises two mating shell halves and means for securing said shell halves together, said clean-out door and said battery cap interlocking with each other and further securing said shell halves together.

12. Apparatus for trimming hair and recovering cut hair strands for disposal comprising a shell, a stationary blade and a reciprocating blade secured in a selected end of said shell, means in said shell for moving said reciprocating blade to trim the hair, said means for moving said reciprocating blade including a motor, a battery for energizing said motor, and a switch for controlling energy to said motor, said battery being located adjacent to and substantially parallel with said motor, so that the most of the weight of the apparatus is in the user's palm during use, and means for creating air pressure at said blades, whereby undesired accumulation of cut hair strands in said shell is inhibited.

13. The apparatus of claim 12 wherein said shell includes an inclined side wall which extends from a vertical side wall at an angle of about 45 degrees to said vertical side wall, said switch being located on said inclined wall in about the center of said shell.

* * * * *